United States Patent [19]

Phillips et al.

[11] Patent Number: 4,726,570

[45] Date of Patent: Feb. 23, 1988

[54] APPARATUS AND METHOD FOR CASTING REFRACTORY LININGS IN LADLES

[75] Inventors: Robert H. Phillips, DuBois, Pa.; Robert D. Eckert, Valparaiso, Ind.; Alan L. Fisch, Kylertown, Pa.; Glen H. Mead, III, Valparaiso, Ind.

[73] Assignee: North American Refractories Company, Cleveland, Ohio

[21] Appl. No.: 1,000

[22] Filed: Jan. 7, 1987

[51] Int. Cl.[4] ..... C21C 5/44

[52] U.S. Cl. ..... 266/281; 264/30

[58] Field of Search ..... 266/281, 275, 44; 264/30

[56] References Cited

U.S. PATENT DOCUMENTS

| | | | |
|---|---|---|---|
| 3,151,200 | 9/1964 | Spencer | 266/281 |
| 3,944,193 | 3/1976 | Imai et al. | 266/281 |
| 4,589,633 | 5/1986 | Gilson et al. | 266/281 |

FOREIGN PATENT DOCUMENTS

| | | | |
|---|---|---|---|
| 0735384 | 5/1980 | U.S.S.R. | 266/281 |
| 0893402 | 12/1981 | U.S.S.R. | 266/281 |

*Primary Examiner*—L. Dewayne Rutledge
*Assistant Examiner*—S. Kastler
*Attorney, Agent, or Firm*—Jones, Day, Reavis & Pogue

[57] ABSTRACT

A ladle of the type having a bottom wall, sidewall and opposite trunnions extending outwardly from an upper portion of the sidewall is provided with a refractory lining by positioning a mandrel inside of the ladle in spaced relationship to the walls thereof to define a castable space. The mandrel is attached to an elongated horizontal support which extends over the top of the ladle. The elongated horizontal support is supported by the ladle trunnions and is also locked thereto against upward displacement. At least a portion of the mandrel which cooperates with the ladle sidewall is expandable and collapsible toward and away from the ladle sidewall. After the castable space is filled with castable refractory material, such material is allowed to solidify, and the elongated horizontal support is released from the trunnions so that the support and mandrel attached thereto can be lifted upwardly.

19 Claims, 14 Drawing Figures

APPARATUS AND METHOD FOR CASTING REFRACTORY LININGS IN LADLES

BACKGROUND OF THE INVENTION

This application pertains to the art of lining vessels, and more particularly, to lining vessels with a castable material. The invention is particularly applicable to casting refractory linings in ladles and will be described with specific reference thereto. However, it will be appreciated that the invention has broader aspects, and at least certain features thereof may be used for other purposes.

In lining a ladle with refractory material, it is common to brick in the bottom and to cast the sidewall. A collapsible mandrel used for casting the sidewall must be sealed at its intersection with the brick bottom. This seal is extremely difficult to maintain, and significant amounts of castable refractory leak past the seal beneath the bottom edge of the collapsible mandrel. Once the cast refractory solidifies, it is necessary to ram a fillet at the intersection between the brick bottom and the cast sidewall refractory.

It would be desirable to have the capability of casting a ladle bottom, and to simultaneously cast a ladle bottom and sidewall.

SUMMARY OF THE INVENTION

Apparatus of the type described includes mandrel means positionable inside of a ladle in spaced relationship to at least one wall thereof to define a castable space for refractory material. Horizontal support means attached to the mandrel means is positionable across the top of the ladle. Trunnion support means on the horizontal support means is provided for supporting the horizontal support means on the ladle trunnions which extend outwardly from the ladle sidewall. Locking means is provided for locking the trunnion support means to the trunnions for holding the mandrel means and horizontal support means against upward vertical displacement.

In one arrangement, the mandrel means comprises a bottom mandrel for casting a bottom wall. In another arrangement, the mandrel means includes both a mandrel bottom wall and a mandrel sidewall which are connected to one another.

The castable refractory material imparts a substantial buoyant force to the mandrel means, and the locking means for locking the trunnion support means to the ladle trunnions holds the mandrel means in the ladle against the action of the buoyant force.

Locating means is provided for locating the mandrel means within the ladle, such that the sidewall castable space has a substantially uniform thickness. In one arrangement, the locating means includes alignment means on the bottom mandrel for cooperation with reference means on the ladle bottom wall. The reference means may comprise the ladle well block.

It is a principal object of the invention to provide an improved apparatus and method for lining a ladle with refractory material.

It is another object of the invention to provide an improved arrangement for repairing a refractory bottom wall in a ladle.

It is also an object of the invention to provide an improved arrangement for casting both a ladle refractory bottom wall and sidewall.

It is a further object of the invention to provide an arrangement for supporting and holding a mandrel within a ladle by using the ladle trunnions.

DESCRIPTION OF PREFERRED EMBODIMENTS

Figure 1:
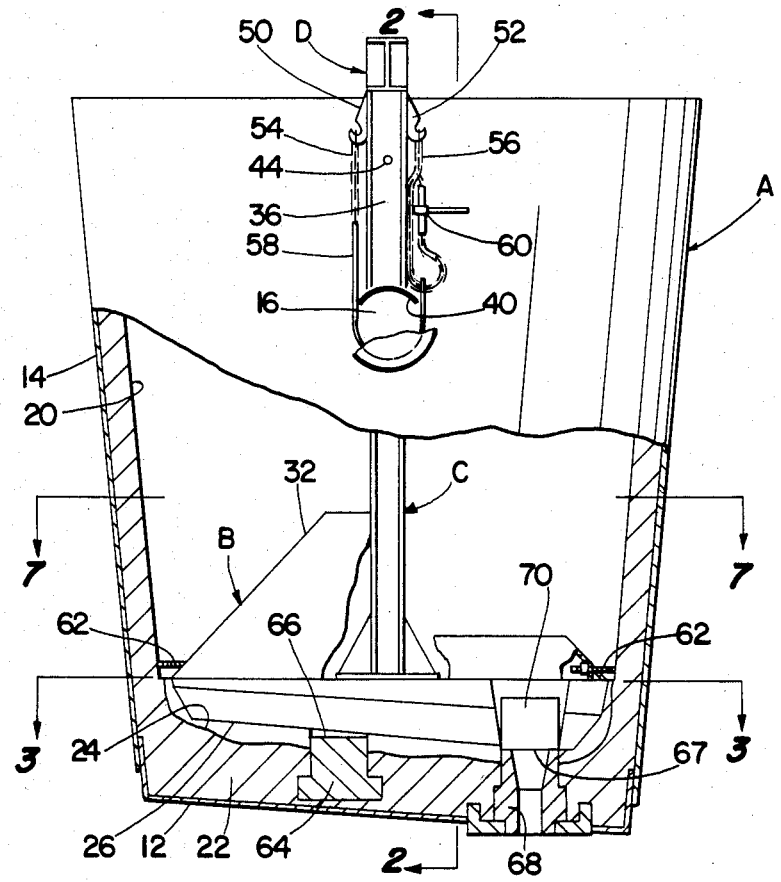
FIG. 1 is a side elevational view of a ladle with portions cut-away and in section for clarity of illustration.

Referring now to the drawing, wherein the showings are for purposes of illustrating preferred embodiments of the invention only and not for purposes of limiting same, FIG. 1 shows a ladle A having a bottom wall 12 and a sidewall 14. Opposite trunnions 16, 18 extend outwardly from an upper portion of ladle sidewall 14. The interior of ladle A is lined with a sidewall refractory 20 and a bottom wall refractory 22. During use of ladle A, refractory bottom wall 22 becomes eroded as generally indicated at 24 in FIGS. 1 and 2, and renewal thereof is necessary.

Mandrel means positionable within ladle A comprises a bottom mandrel B having a mandrel bottom 26, a mandrel upper peripheral edge 28, a mandrel periphery 30 which slopes inwardly in a direction from mandrel upper edge 28 toward mandrel bottom 26, and a pouring skirt 32 which slopes inwardly and upwardly from upper edge 28.

Vertical support means C attached to bottom mandrel B is in turn attached to elongated horizontal support means D which extends across the top of ladle A. Trunnion support means 36, 38 extends downwardly from horizontal support means D outwardly of ladle A. Trunnion support means 36, 38 include arcuate supports 40, 42 resting on cylindrical surface portions of trunnions 16, 18. Thus, bottom mandrel B is supported within ladle A on ladle trunnions 16, 18.

Trunnion support means 36, 38 are provided with threaded holes receiving adjustment screws 44, 46 which engage ladle sidewall 14 for properly locating bottom mandrel B within ladle A in a direction extending between trunnions 16, 18.

Trunnion support means 36, 38 are provided with hooks 50, 52 over which chains 54, 56 are engageable. A band 58 is attached to chains 54, 56, and a load binder 60 is provided for taking up slack in chain 56. Band 58 is extended beneath trunnions 16, 18, and load binders 60 are operated to take up the slack so that band 58 firmly engages the bottom portion of each trunnion 16, 18, and arcurate supports 40, 42 are compressed downwardly against trunnions 16, 18. The described arrangement provides a locking means for locking the entire mandrel assembly to trunnions 16, 18 against upward vertical displacement.

Bottom mandrel B is provided with a plurality of circumferentially-spaced horizontal adjustment screws 62 which engage refractory sidewall 20 for properly locating bottom mandrel B within ladle A.

A porous plug 64 in the bottom of ladle A, for bubbling gas through molten metal in the ladle, is suitably shielded by a protective cover 66 before the eroded portion of the refractory bottom wall is renewed. A suitable hole 67 in bottom 26 of bottom mandrel B is aligned with ladle well block 68 for a well block slide gate valve. A weight 70 is positioned over the outlet opening in well block 68 for sealing same against castable refractory material used to renew the refractory bottom wall.

Figure 2:
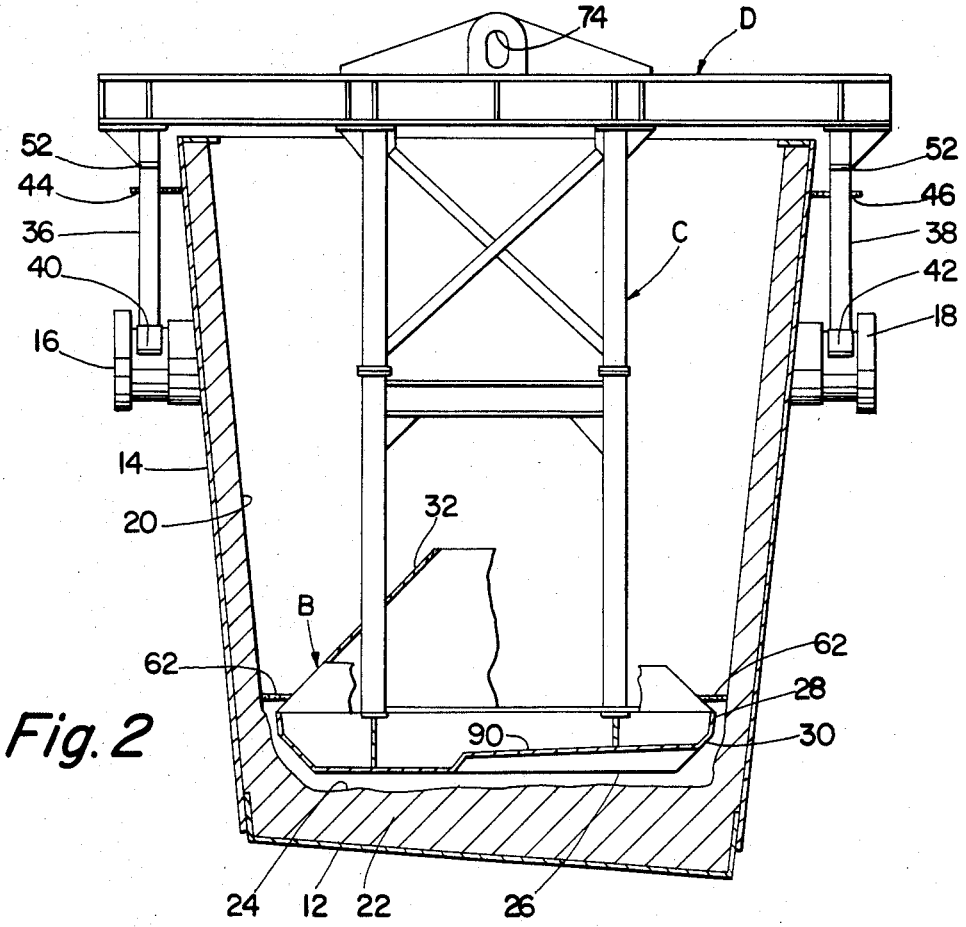
FIG. 2 is a cross-sectional elevational view taken generally on-line 2—2 of FIG. 1.

With the mandrel means in position as shown in FIGS. 1 and 2, castable refractory material poured into ladle A strikes pouring skirt 32, and flows around mandrel upper edge 28 and mandrel periphery 30, into the castable space defined between mandrel bottom 26 and eroded refractory surface 24. The castable space is completely filled with castable refractory material, and mandrel means B is left in position until the castable refractory solidifies. Obviously, suitable vibrators may be attached to mandrel means B during pouring of the castable refractory. When the castable refractory has solidified, the locking means which locks the entire assembly to trunnions 16, 18 are released, and the entire assembly is lifted from the ladle by use of suitable lifting equipment attached to lifting eye 74.

Figure 3:
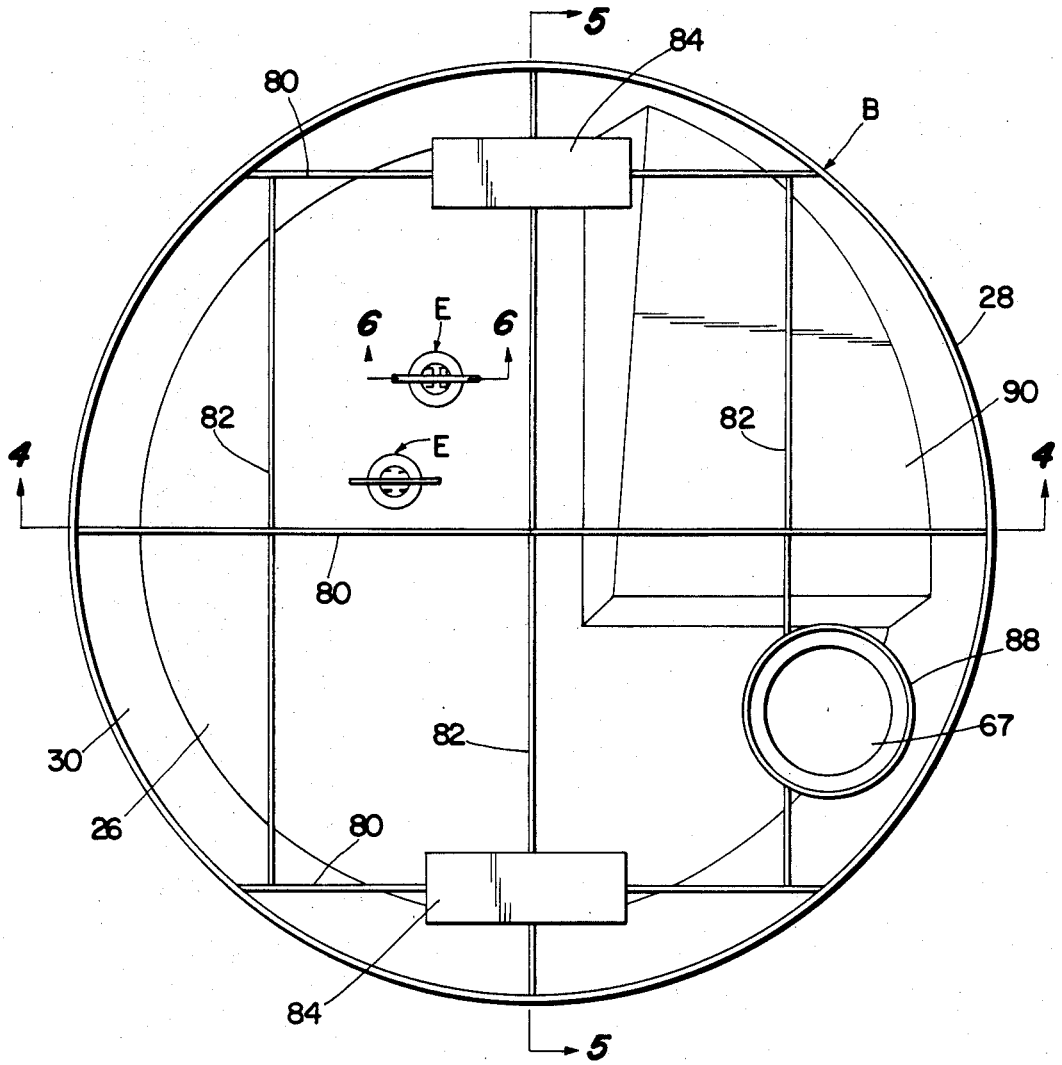
FIG. 3 is a partial cross-sectional plan view taken generally on-line 3—3 to show a portion of a bottom mandrel.
Figure 4:
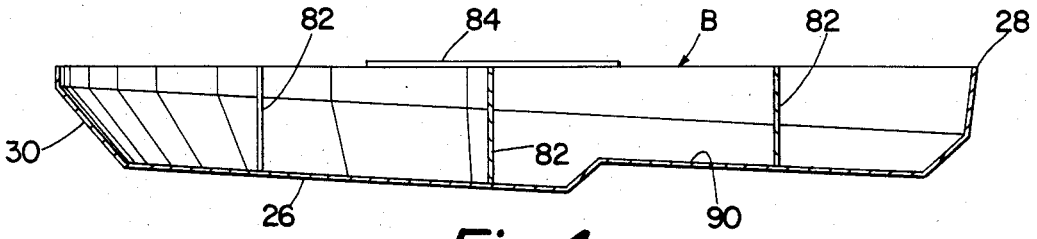
FIG. 4 is a cross-sectional elevational view taken generally on 4—4 of FIG. 3.
Figure 5:
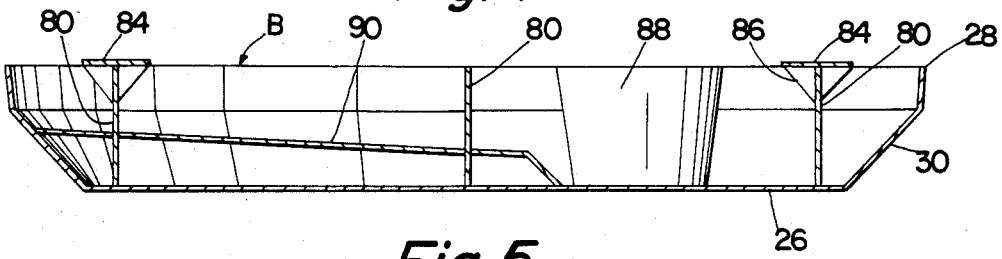
FIG. 5 is a cross-sectional elevational view taken generally on-line 5—5 of FIG. 3.
Figure 6:
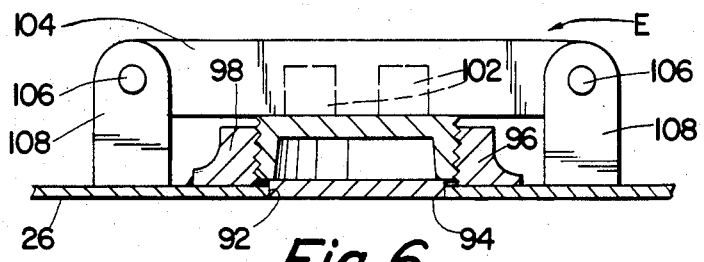
FIG. 6 is a cross-sectional elevational view taken generally on-line 6—6 of FIG. 3.

With reference to FIGS. 3–5, the lower portion of bottom mandrel B is reinforced by a first plurality of spaced-apart parallel ribs 80 welded across peripheral wall 30 and bottom wall 26. A second plurality of similarly welded spaced-apart parallel ribs 82 extend perpendicular to first ribs 80. Plates 84 are welded to the upper edges of intersecting ribs 80, 82 for attachment of vertical support means C of FIG. 2 thereto. Suitable gussets 86 may be welded beneath plates 84 and to ribs 80.

Hole 67 alignable with the ladle well block is surrounded by an inverted frusto conical member 88 in which weight 70 of FIG. 1 is received. Suitable packing material is placed between the weight and member 88 for sealing hole 67 against passage of castable refractory material.

As best shown in FIG. 1, mandrel bottom 26 slopes downwardly toward hole 67 therein and toward ladle well block 68. This allows the castable refractory material poured into the ladle against pouring skirt 32 to better fill the castable space. As shown in FIG. 3, mandrel bottom 26 is also provided with a raised area 90 which occupies substantially less than ½ the area of bottom 26. When the refractory bottom wall is renewed, raised area 90 provides a refractory bottom area of substantially increased thickness to form a pouring pad against which molten metal may be poured into the ladle.

FIG. 3 shows suitable sight ports E in mandrel bottom 26 which may be used for viewing the porous plug or another reference point in the ladle bottom for properly locating bottom mandrel B therein. Each viewing port E includes a viewing hole 92 through mandrel bottom 26. A circular plug 94 attached to an externally threaded member 96 is provided for selectively closing viewing hole 92. An internally threaded ring 98 welded to the interior surface of mandrel bottom 26 cooperably receives member 96. Spaced projections 102 extending upwardly from member 96 have a rod 104 extending therebetween for preventing rotation of member 96. Rod 104 is attached by removable pins 106 to members 108 extending upwardly from mandrel bottom 26.

Figure 7:
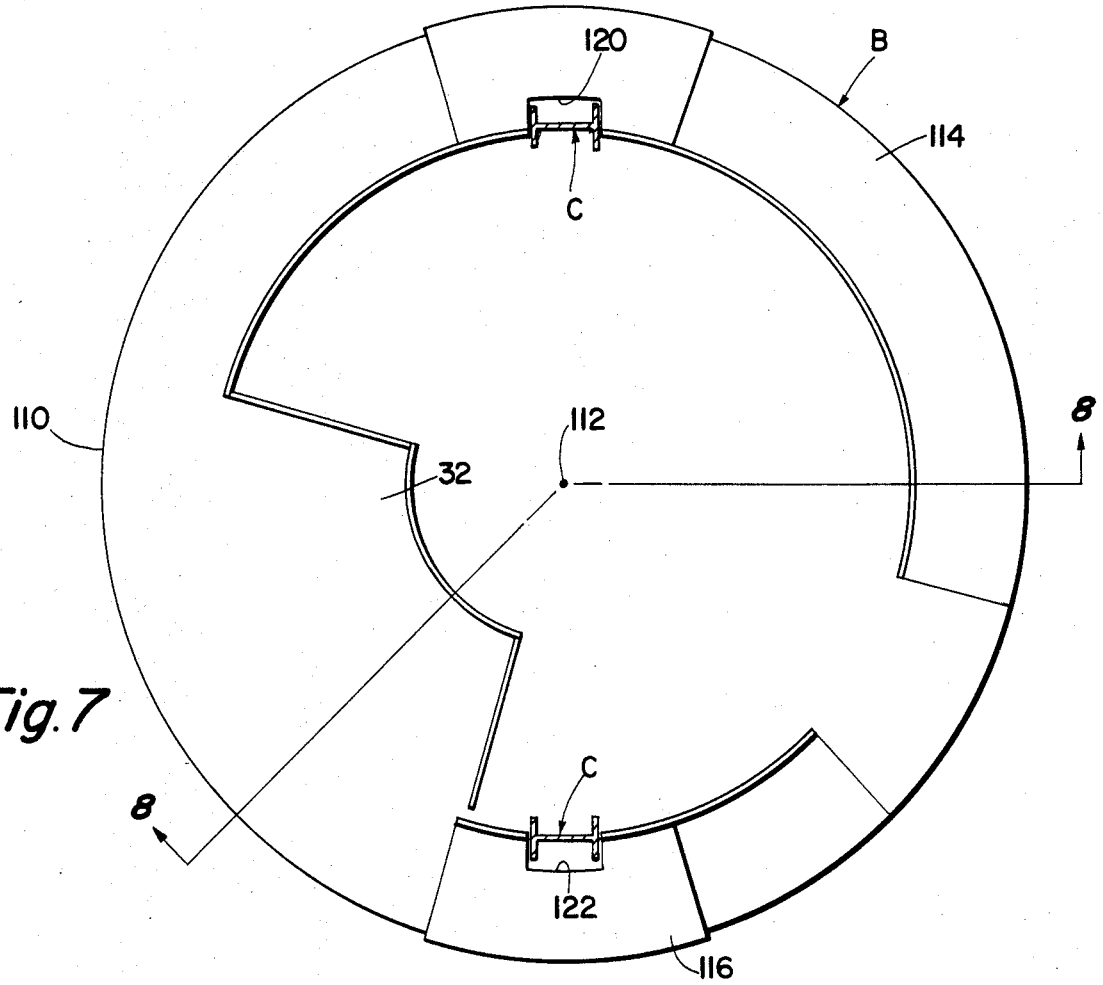
FIG. 7 is a plan view of a bottom mandrel looking generally in the direction of arrows 7—7 of FIG. 1.
Figure 8:
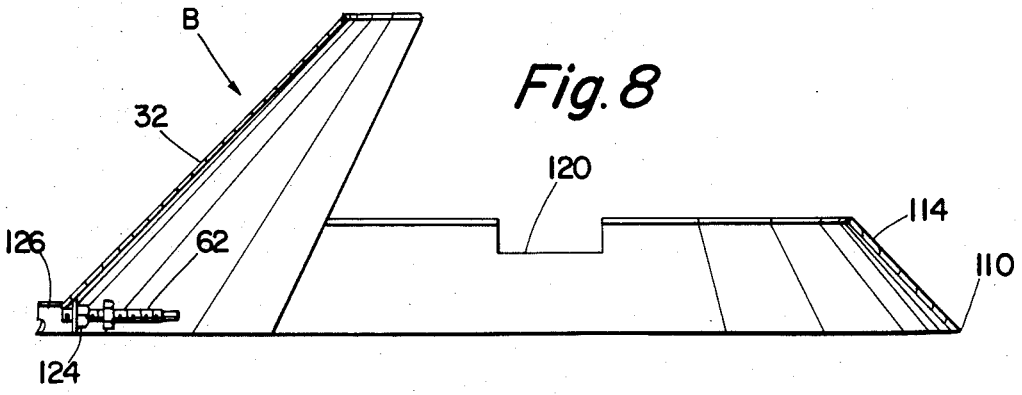
FIG. 8 is a cross-sectional elevational view taken generally on-line 8—8 of FIG. 7.

FIGS. 7 and 8 show the upper portion of bottom mandrel B. Pouring skirt 32 extends over an arc substantially less than 180 degrees, and extends inwardly from outer edge 110 toward center line 112, a distance which is greater than ½ the distance from outer edge 110 to center line 112. Pouring skirt 32 slopes upwardly from outer edge 110 at an angle greater than 30 degrees. Smaller skirts 114, 116 slope upwardly from outer edge 110 at the same angle as pouring skirt 32, and extend around most of the remainder of the upper portion of the mandrel. Skirts 114, 116 are suitably notched at 120, 122 for receiving vertical support means C as shown in FIG. 7. Adjusting screws 62 are attached to the upper skirt portion of the mandrel, as shown in FIG. 8, by threading same through bolts 124 welded to suitable vertical plates which in turn are welded to the skirt. Generally cylindrical sleeves 126 are welded to the skirt in alignment with adjusting screws 62 for protecting same against castable refractory material, and to keep castable refractory material from entering the interior of the mandrel.

The upper portion of the mandrel shown in FIGS. 7 and 8 is suitably welded to the upper edge of the lower portion of the mandrel shown in FIGS. 3–5. Adjusting screws 62 define lateral locating means for cooperation with the refractory sidewall of the ladle to laterally locate the bottom mandrel in proper position.

FIGS. 9–13 show another arrangement wherein elongated horizontal support means D' has a first pair of spaced-apart parallel support beams 130 extending substantially parallel to an axis connecting the ladle trunnions. Another pair of spaced-apart parallel support beams 132 extend perpendicular to beams 130. Trunnion support means 36', 38' include saddles 134, 136 for resting upon trunnions 16, 18 and supporting elongated horizontal support means D' thereon. Saddles 134, 136 have arcuate recesses corresponding to the curvature of trunnions 16, 18 for resting thereon. Adjusting screws 44', 46' engage the outer surface of ladle A for adjusting the support means in a direction parallel to an axis connecting trunnions 16, 18.

Figure 9:
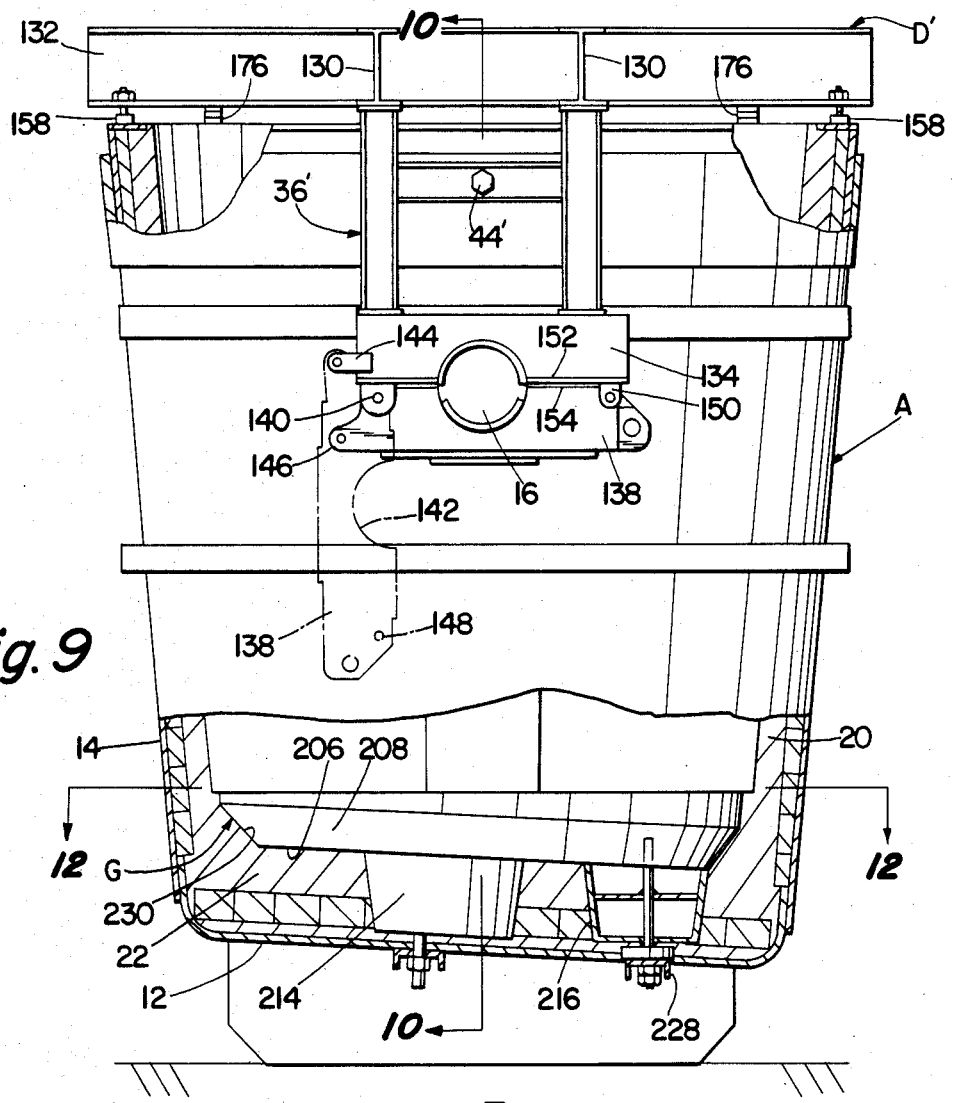
FIG. 9 is a side elevational view of a ladle with portions cut-away and in section for clarity of illustration.

Each trunnion support means includes a bail 138 hingedly connected as at 140 with a saddle 134 for movement between the solid and shadow line positions shown in FIG. 9. Bail 138 has an arcuate recess 142 corresponding in size and shape to the curvature of trunnion 16 for firmly engaging same. A bracket 144 on saddle 134 has a suitable hole therethrough alignable with a hole 146 on bail 138 when the bail is in its shadow line position. A pin may be extended through the aligned holes in the bracket and bail for releasably holding the bail in its open shadow line position. Swinging movement of bail 138 from the shadow line position about hinge 140 to the solid line position aligns another bail hole 148 with a hole in other saddle bracket 150, and a pin may be extended through the aligned holes for holding the bail in its locked position. Saddle 134 and bail 138 have flanges 152, 154 thereon which may have aligned holes therethrough for receiving bolt and nut assemblies to securely lock bail 138 in its locking position for preventing upward movement of elongated horizontal support means D'. The fit of saddles & bails on the trunnions may be such that the arcuate recesses on the saddles & bails are compressed against the trunnions.

Beams 132, which extend perpendicular to an axis connecting trunnions 16, 18, are provided with adjustable feet 158 resting on the upper end of ladle A to provide adjustment for elongated horizontal support means D' about the axis connecting trunnions 16, 18.

The mandrel means in the arrangement of FIGS. 10–13 includes a sidewall mandrel F and a bottom mandrel G cooperably connected together. Sidewall mandrel F is expandable toward, and contractible away from, the sidewall of ladle A. In other words, sidewall mandrel F is also expandable and contractible outwardly and inwardly relative to its own longitudinal axis. Sidewall mandrel F includes a pair of opposite arcuate sidewall segments 160, and a pair of opposite wedge segments 162. Each wedge segment 162 has opposite side flanges 164 which converge in a direction proceeding outwardly from longitudinal center line 166 of sidewall mandrel F toward the outer periphery thereof. Arcuate segments 160 have side flanges 168 which are sloped to extend parallel with side flanges 164 of wedge segments 162. Side flanges 164, 168 have aligned laterally elongated slots therein receiving spring loaded bolt and nut assemblies for connecting such side flanges together while allowing relative sliding movement therebetween.

The upper portions of sidewall arcuate segments 160 have inwardly and upwardly inclined surfaces 170, and substantially horizontal top flanges 172. Elongated slots 174 in top flanges 172 are provided for receiving spring loaded bolt and nut assemblies to attach the mandrel means to elongated horizontal support means D' as generally indicated at 176 in FIG. 10. Wedge segments 162 have inwardly and upwardly inclined surface portions 180, and substantially horizontal top flanges 182.

A mechanism H for expanding and collapsing the mandrel means includes a plurality of links 186 pivotally connected as at 188 adjacent one end thereof to wedge segments 162, and pivotally connected as at 190 adjacent the opposite ends thereof with a central vertical rod 192. A lifting eye 194 is attached to rod 192, and a plurality of additional lifting links or cables 196 may be connected between lifting eye 194 and wedge segments 162. An upward lifting force on rod member 192 moves links 186 to the inclined solid line positions for moving wedge segments 162 inwardly to the position shown in FIG. 11. Inward movement of wedge segments 162 also moves arcuate segments 160 inwardly toward one another. Forceable downward movement of rod member 192 causes links 186 to move to the shadow line positions for moving wedge segments 162 outwardly which also expands arcuate segments 160 outwardly away from one another. Obviously the expandable and contractible sidewall mandrel may take other forms, including that disclosed in U.S. Pat. No. 4,602,771 issued July 29, 1986, to Milliron, et al.

Figure 12:
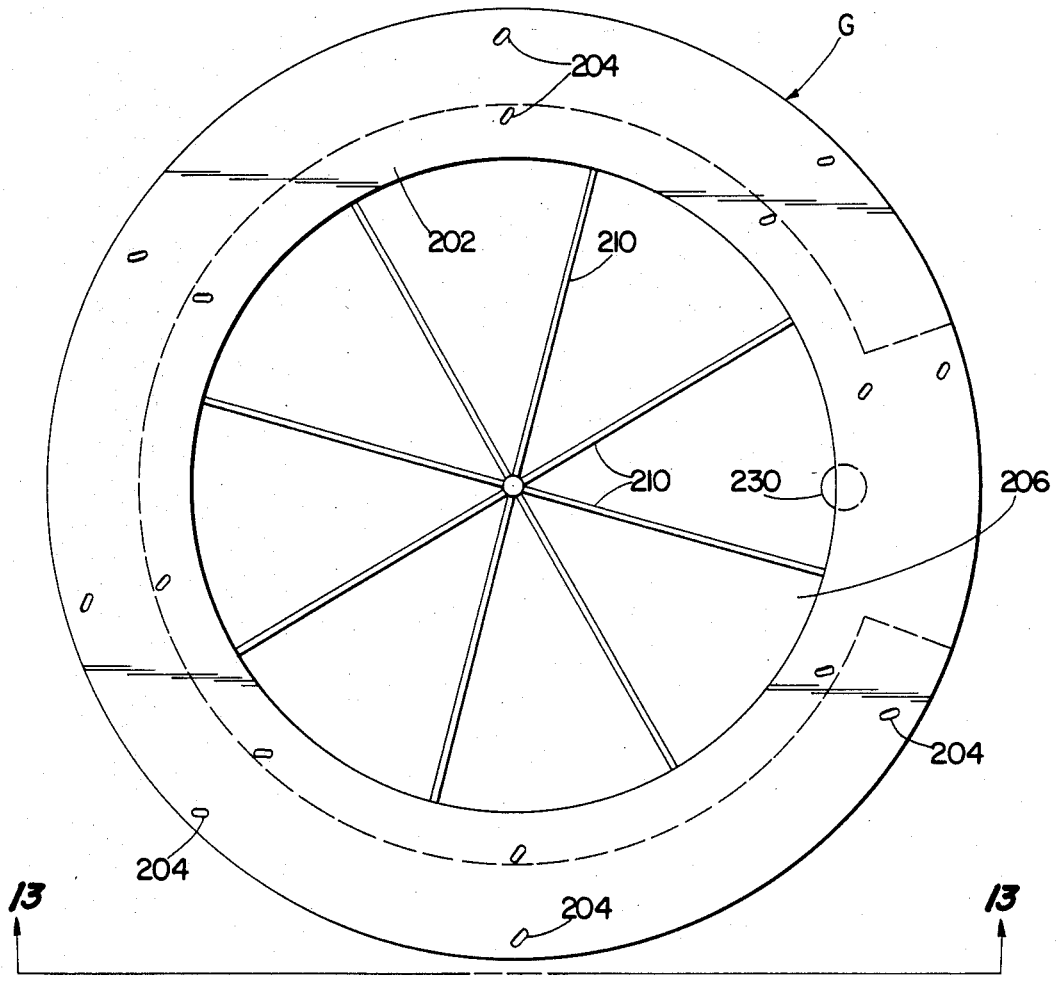
FIG. 12 is a partial cross-sectional plan view looking generally in the direction of arrows 12—12 of FIG. 9.
Figure 13:
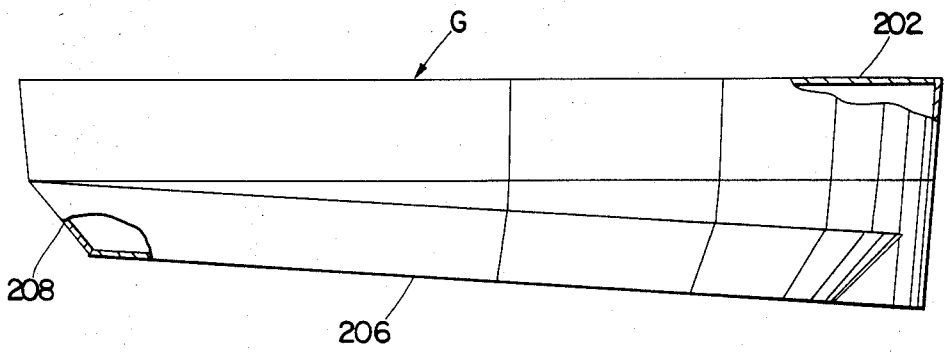
FIG. 13 is a side elevational view taken generally on-line 13—13 of FIG. 12.

As shown in FIGS. 12 and 13, bottom mandrel G has a substantially horizontal top flange 20 with a plurality of elongated slots 204 therein. The bottom portions of at least arcuate segments 160 have substantially horizontal inwardly extending bottom flanges thereon with elongated slots alignable with slots 204. Spring loaded bolt and nut assemblies passing through the slots in flange 202 and the slots in the bottom flange on sidewall segments 160 hold sidewall mandrel F to bottom mandrel G, while allowing outward and inward expansion and contraction of sidewall mandrel F relative to bottom mandrel G. Bottom mandrel G has a bottom wall 206 which slopes in a direction toward the ladle well block. The lower periphery of bottom mandrel G is inclined inwardly as at 208 to provide a fillet between a cast refractory sidewall and a cast refractory bottom wall. A plurality of rib plates 210 are welded to the interior of bottom mandrel G for reinforcing same.

Figure 14:
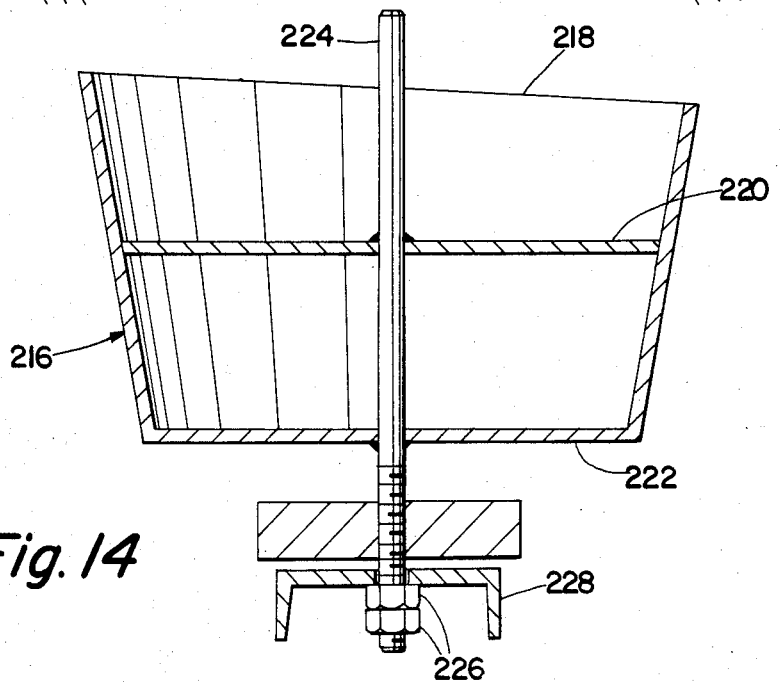
FIG. 14 is a cross-sectional elevational view of a block-out form.
Figure 10:
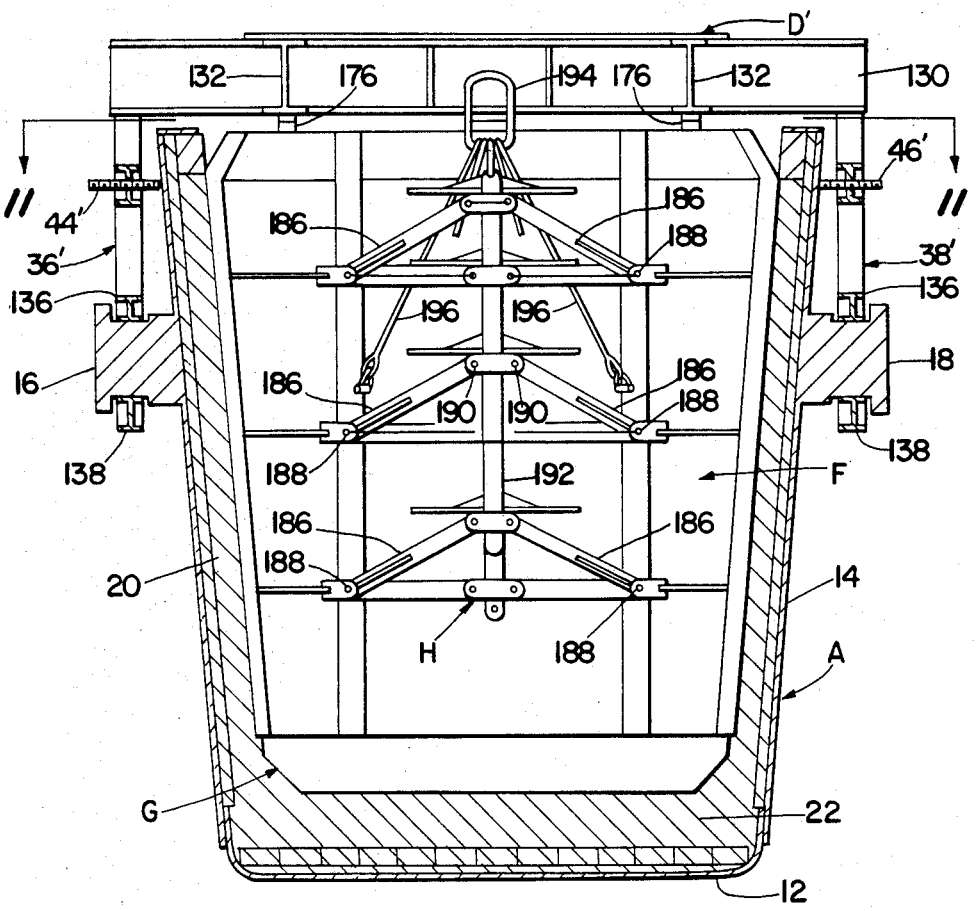
FIG. 10 is a cross-sectional elevational view taken generally on line 10—10 of FIG. 9.
Figure 11:
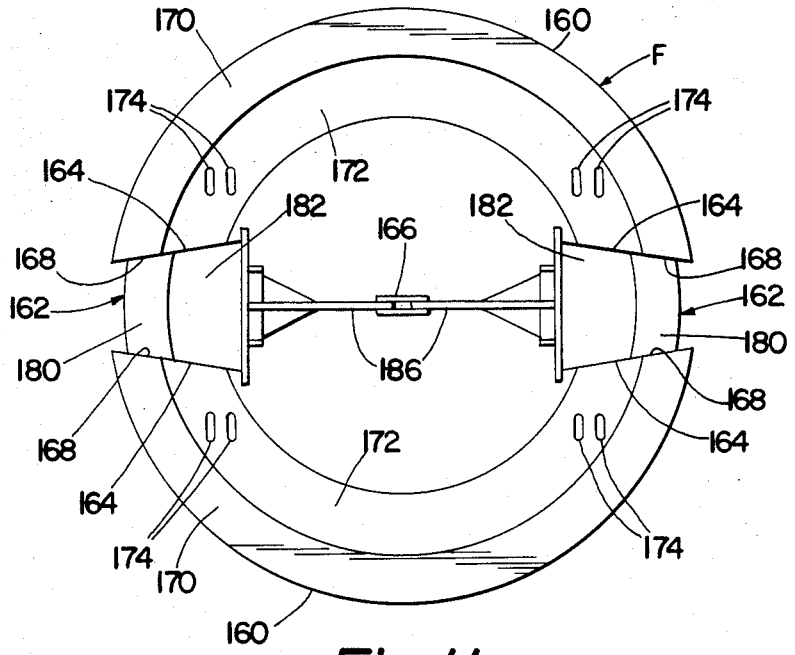
FIG. 11 is a partial plan view looking generally in the direction of arrows 11—11 of FIG. 10 to show the top part of the mandrel.

Block out forms 214, 216 are placed within the bottom of ladle A to provide openings for a porous plug and a well block after the lining is cast. As shown in FIG. 14, block out form 216 is a generally inverted frusto conical member having an inclined upper edge 218 for closely fitting against bottom wall 206 of bottom mandrel G. Block out form 216 has a central plate 220 welded thereacross and a closed bottom end 222. An elongated rod 224 is welded through suitable holes in plates 220, 222. The free outer end of rod 224 is threaded for receiving nuts 226 which clamp a channel member 228 against the outside surface of ladle bottom wall 12 to hold the block out form 216 in position within the ladle. With nuts 226 and channel 228 removed, block out form 216 is placed inside of ladle A prior to positioning of the mandrel means therein. Channel 228 and nuts 226 are then applied to the threaded end portion of rod 224 which extends through the well block hole in the ladle bottom wall. Rod 224 extends upwardly above upper edge 218 for reception in a hole 230 (FIG. 12) in bottom wall 206 of bottom mandrel G. Alignment of hole 230 with pin 224 substantially centers the mandrel means within ladle A so that refractory sidewall 20 will be of substantially uniform thickness. Obviously, many other arrangements are possible for substantially centering the mandrel means within the ladle, including providing indicia in the bottom of the ladle for viewing through a closeable sight port in the mandrel bottom. Thus, hole 230 in bottom mandrel G may be considered an alignment means for cooperation with a reference means defined by rod 224 in the ladle bottom wall. Obviously, other alignment means and reference means may be provided for properly centering the mandrel means.

The spring loaded bolt and nut assemblies which connect the sidewall mandrel to the bottom mandrel may be considered slip connecting means for providing expansion and contraction movement of the sidewall mandrel relative to the bottom mandrel, and between the wedge segments and arcuate segments. The bolt and nut assemblies may include belleville-type of washers or coil springs and flat washers. Obviously, other types of slip connecting means may be provided.

When the mandrel means is properly located within ladle A, sidewall mandrel F is spaced inwardly from ladle sidewall 14 and cooperates therewith to define a castable sidewall space. Likewise, bottom mandrel G is spaced upwardly above the bottom of ladle A to define a castable bottom space. With the mandrel means in its expanded position, castable refractory material is supplied into the castable sidewall space whereupon it flows downwardly into the castable bottom wall space and eventually fills all of the castable spaces. When the castable material is in its flowable state, a significant buoyant force is imparted to the mandrel means, and the locking means defined by bails 138 prevent upward displacement of the entire mandrel assembly and its supporting structure. Inwardly sloping lower wall 208 on bottom mandrel G provides the formation of an inclined fillet 230 at the intersection between refractory bottom wall 22 and refractory sidewall 20 which are cast in situ.

Although the present invention has been shown and described with respect to certain preferred embodiments, it is obvious that equivalent alterations and modifications will occur to others skilled in the art upon a reading and understanding of this specification. The present invention includes all such equivalent alterations and modifications, and is limited only by the scope of the claims.

What is claimed is:

1. Apparatus for casting a refractory lining in at least part of a ladle having a bottom wall and a sidewall and opposite trunnions extending outwardly from an upper portion of the sidewall, said apparatus including elongated horizontal support means positionable across the top of the ladle and having trunnion support means extending downwardly therefrom for engaging the ladle trunnions and supporting said horizontal support means thereon, locking means for locking said trunnion support means to the trunnions against vertical displacement relative thereto, and mandrel means attached to said horizontal support means for location inside the ladle in spaced relationship to at least one wall thereof to define a castable space into which castable refractory is transferable for forming a lining on the one wall.

2. The apparatus of claim 1 wherein said mandrel means comprises a bottom mandrel positionable in spaced relationship to the bottom wall of the ladle to define a castable bottom space into which castable refractory is transferable for forming a bottom lining in the ladle.

3. The apparatus of claim 2 wherein said bottom mandrel includes adjustable lateral locating means for cooperation with the sidewall of the ladle to laterally locate said bottom mandrel in proper position.

4. The apparatus of claim 2 wherein said bottom mandrel has a mandrel bottom, a mandrel upper edge and a mandrel periphery which slopes inwardly from said mandrel upper edg toward said mandrel bottom.

5. The apparatus of claim 4 including a pouring skirt extending inwardly and upwardly from said mandrel upper edge whereby castable refractory poured into the ladle strikes said pouring skirt and flows downwardly around said mandrel periphery into the castable bottom space beneath said bottom mandrel.

6. The apparatus of claim 4 wherein the ladle has a well block outlet in the bottom wall thereof adjacent the peripheral wall thereof and said mandrel bottom slopes downwardly toward the well block outlet.

7. The apparatus of claim 6 wherein said mandrel bottom has a raised area which occupies substantially less than one-half the total area of said mandrel bottom for providing a portion of said castable bottom space with an area of increased thickness.

8. The apparatus of claim 1 wherein said mandrel means includes a bottom mandrel positionable in spaced relationship to the ladle bottom wall to define a castable bottom space and a sidewall mandrel extending upwardly from said bottom mandrel and being positionable in spaced relationship to the ladle sidewall to define a castable sidewall space, said mandrel means being subjected to buoyant force tending to lift same from the ladle when the castable spaces are filled with castable refractory, and said horizontal support means and trunnion support means providing resistance to the buoyant force for holding said mandrel means within the ladle until the castable refractory cures.

9. The apparatus of claim 8 wherein said sidewall mandrel is selectively expandable and contractible toward and away from the ladle sidewall.

10. The apparatus of claim 9 wherein said bottom mandrel and sidewall mandrel are attached together by slip connecting means for providing expansion and contraction movement of said sidewall mandrel relative to said bottom mandrel.

11. The apparatus of claim 8 including locating means for locating said mandrel means within the ladle such that the sidewall castable space has a substantially uniform thickness.

12. The apparatus of claim 11 wherein said locating means includes alignment means on said bottom mandrel for alignment with reference means on the ladle bottom wall.

13. The apparatus of claim 12 wherein the ladle includes a well block in its bottom wall and the reference means is defined by the well block, said alignment means on said bottom mandrel comprising an opening located such that alignment of such opening with the well block substantially centers said mandrel means within the ladle.

14. Apparatus for casting a refractory lining in a ladle having a bottom wall, a sidewall and opposite trunnions extending outwardly from an upper portion of the ladle sidewall, said apparatus including elongated horizontal support means positionable across the top of the ladle, mandrel means attached to said horizontal support means and positionable within the ladle in spaced relationship to at least one of the ladle walls to define a castable space when said horizontal support means is positioned across the top of the ladle, and locking means for locking said horizontal support means to the ladle trunnions against upward displacement for holding said mandrel means within the ladle.

15. The apparatus of claim 14 wherein said mandrel means includes a sidewall mandrel and a bottom mandrel, said sidewall mandrel being expandable and collapsible toward and away from the ladle sidewall.

16. The apparatus of claim 14 wherein said horizontal support means includes trunnion support means for engaging the ladle trunnions and supporting said horizontal support s thereon above the top of the ladle.

17. A method of casting refractory linings in ladles having a bottom wall, a sidewall and opposite trunnions extending outwardly from an upper portion of the sidewall comprising the steps of:

attaching mandrel means to elongated horizontal support frame means having trunnion supports extending downwardly therefrom;

lowering said mandrel means into the ladle until said trunnion supports engage the ladle trunnions for locating said mandrel means in spaced relationship to at least one of said ladle walls to define a castable space;

locking said trunnion supports to said ladle trunnions against upward displacement relative thereto;

transferring castable refractory material into said castable space;

allowing said refractory material to solidify;

releasing said trunnion supports from said ladle trunnions; and lifting said elongated horizontal support means away from said ladle to remove said mandrel means from said ladle.

18. The method of claim 17 wherein said mandrel means includes a sidewall mandrel which is expandable and collapsible toward and away from said ladle sidewall, said step of lowering said mandrel means into said ladle being carried out with said sidewall mandrel in a collapsed condition, said method including the steps of expanding said sidewall mandrel prior to said step of transferring castable refractory into said castable space and collapsing said sidewall mandrel subsequent to solidification of said castable refractory material and prior to lifting of said mandrel means from said ladle.

19. The method of claim 17 wherein said mandrel means includes a bottom mandrel and including the step of centering said bottom mandrel within said ladle prior to said step of transferring castable refractory material to said castable space.

* * * * *